United States Patent [19]

Bushey

[11] 4,366,094

[45] Dec. 28, 1982

[54] CONDUCTOR COMPOSITIONS

[75] Inventor: William R. Bushey, Lewiston, N.Y.

[73] Assignee: E. I. Du Pont de Nemours and Company, Wilmington, Del.

[21] Appl. No.: 230,385

[22] Filed: Feb. 2, 1981

[51] Int. Cl.[3] ..... H01B 1/02

[52] U.S. Cl. ..... 252/512; 106/286.5

[58] Field of Search ..... 501/14, 75; 252/512; 106/286.5

[56] References Cited

U.S. PATENT DOCUMENTS

| | | | |
|---|---|---|---|
| 4,000,026 | 12/1976 | Rexer | 252/512 |
| 4,122,232 | 10/1978 | Kuo | 428/323 |
| 4,148,761 | 4/1979 | Kazmierowicz | 428/457 |
| 4,197,218 | 4/1980 | McKaveney | 252/512 |
| 4,207,369 | 6/1980 | Kazmierowicz | 428/201 |
| 4,255,291 | 3/1981 | Needes et al. | 252/512 |

*Primary Examiner*—Theodore Morris

[57] ABSTRACT

Conductor compositions comprising an admixture of finely divided particles of (a) silicon dispersed in a matrix of aluminum and (b) glass.

12 Claims, No Drawings

CONDUCTOR COMPOSITIONS

FIELD OF THE INVENTION

The invention is related to thick film conductor compositions and particularly to thick film conductor compositions for use in automotive window defoggers.

BACKGROUND OF THE INVENTION

In recent years automobile manufacturers have offered as optional equipment rear windows which can be defrosted and/or defogged by use of an electrically conductive grid permanently attached to the window. In order to defrost quickly the circuit must be capable of supplying large amounts of power from a low voltage power source, for example, 12 volts. Furthermore, the lines of the conductive grid must be sufficiently narrow in order to maintain visibility through the rear window.

Heretofore, the materials used for the preparation of window defogging grids have mostly been thick film silver conductors which are prepared from paste comprising finely divided silver powder particles and glass frit dispersed in an organic medium. In a typical application a paste containing by weight 70% silver powder, 5% glass frit and 25% organic medium is screen printed through a 180 Standard Mesh Screen onto a flat, unformed glass rear window. The printed composition is dried for two minutes at about 300° C. and the entire element is then fired in air for from 7 to 10 minutes at 650° C. After firing the softened glass is shaped by pressing into a mold and then tempered by rapidly cooling. During the firing cycle the organic medium is removed by evaporation and pyrolysis. The glass and silver are sintered to form a continuous conductive path with the glass acting as binder.

The silver compositions currently used yield upon firing resistances of from 2 to 15 milliohms per square. The resistance requirements vary according to the size of the conductive grid and hence the window. Conductors for large window areas need more electrical current because they have more area to defrost and therefore have much lower resistance requirements. Thus, the larger rear window area is typical of full sized cars require as little as 2 milliohms per square resistance, whereas the relatively small rear window area which is typical of compact cars can utilize compositions having resistance of as high as 15 milliohms per square.

Because of the current trend toward smaller cars the automotive industry anticipates a decline in the need for very low resistance silver compositions (2 to 4 milliohms per square) and forecasts suggest that the future resistance requirements will be for compositions of from 3 to 8 milliohms per square.

Such resistance requirements for defoggers are easily met by noble metal conductors, particularly silver, which is currently the most widely used conductor material. However, silver conductors are quite expensive, thus, there is a need for base metal conductor compositions which can meet the resistance and other physical requirements for defogger compositions. Unfortunately, the prior art base metal conductors do not sufficiently meet these criteria. For example, U.S. Pat. Nos. 4,148,761 and 4,207,369 are directed to electroconductive materials containing 0.25–30% by weight silicon, 20–90% aluminum and 10–50% glass having a melting point below 660° C. The electronconductive materials are prepared by conventionally firing a mixture of aluminum metal powder silicon metal powder and glass frit. These compositions have been shown to have sheet resistances of from 9 to 18 milliohms per square. Thus, they are not quite good enough for future defogger requirements even though they are relatively inexpensive.

U.S. Pat. Nos. 4,122,232 and 4,148,761 are concerned with the prevention of oxidation of base metals, particularly nickel, upon firing conductor pastes comprising powdered base metal, glass frit and liquid organic medium. Boron powder is added to the composition to reduce oxidation of the base metal upon firing. The resultant conductors are shown to have resistances of as low as 100 milliohms per square. In addition, it has been shown that such boron-containing compositions give defoggers which are highly moisture sensitive. Thus they are further removed from acceptability for use in defogger compositions when the resistance requirements are at a low level of 8 milliohms per square or less.

BRIEF DESCRIPTION OF THE INVENTION

The invention is therefore directed to a conductor composition from which defogger circuits having a resistance of 8 milliohms per square or lower can be made comprising an admixture of finely divided particles of (a) crystallite silicon metal dispersed in a matrix of aluminum metal and (b) glass having a softening point below 600° C., the weight ratio of metal to glass being from 2 to 40.

In practical application the above-described composition of finely divided particles is dispersed in organic medium to form a paste which can be applied by conventional means such as dipping, spraying, brushing and especially screen printing. In a further aspect the invention is directed to supported conductor elements utilizing the above described composition for the conductive pattern and particularly to automotive rear windows having a pattern of the above described composition printed thereon and then fired to effect volatilization of the organic medium and sintering of the glass and metal particles.

DETAILED DESCRIPTION OF THE INVENTION

Conductive Material

To make a successful base metal defogger conductor it is necessary to obtain a low resistance grid after firing in air. It is also necessary for the resultant thick film grid to be resistant to outdoor weather conditions, particularly moisture. Because base metals oxidize upon firing in air, it is necessary to protect the metal when it is fired in that manner. As described in U.S. Pat. Nos. 4,122,232 and 4,148,761, this can be done by having boron metal present. However the resultant fired thick film conductors are unfortunately very susceptible to degradation by moisture. Furthermore, they do not exhibit low enough resistances to be useful for conventional defogger systems.

Silicon can in many ways serve the same protective function as boron, which is illustrated by the above referred U.S. Pat. Nos. 4,148,761 and 4,207,369. Though the silicon containing conductors are very good, they nevertheless are not suitable for resistances of 8 milliohms per square and below even when quite small particle sizes of such metals are used.

The disadvantages of the prior art have been found to be overcome by using as the conductive metal component of the system finely divided particles of silicon dispersed in a matrix of aluminum. (As a practical matter, the aluminum matrix at room temperature may contain a small amount of silicon dissolved therein, but not more than about 0.1%.) This solid state dispersion is produced from a molten solution containing from 1.65 to 25% by weight silicon and from 98.35 to 75% by weight aluminum. Upon cooling this solution forms finely divided particles of silicon dispersed in a matrix of aluminum. It is preferred to employ for this purpose the eutectic composition of about 12% silicon and 88% aluminum which gives the maximum degree of dispersion. The actual eutectic point is at 11.8% silicon and 88.2% aluminum. When noneutectic silicon-aluminum solutions are employed the material in excess of the eutectic amount tends to have larger particle size and is less effective. Thus, while finely divided powder prepared from silicon-aluminum solutions containing from 1.65 to 25% silicon can be used, it is preferred to have 5 to 15% silicon and still more preferably the eutectic proportions of about 12% silicon and 88% aluminum. Fortunately, this product is widely used for brazing aluminum and is therefore commercially available at low cost. The above-described particles are prepared by spray cooling a solution of silicon dissolved in molten aluminum. It should also be noted that the finely divided particles are not an alloy of the metals but are a solid phase dispersion of small particles of silicon in a continuous phase (matrix) of aluminum metal.

The particle size of the aluminum matrix should be of a size appropriate to the manner in which it is applied, which is usually by screen printing. Thus the matrix powder should be no bigger than about 75 μm and preferably should be below about 45 μm. Even though very finely divided particles, for example on the order of to 4 μm, can be employed it is found that the defogger circuits made therefrom are not as low in resistance as when coarser particles on the order of 15 μm are used. This relationship between particle size and resistivity is quite opposite to that which is found in the prior art conductors made from silicon and aluminum powders. In systems such as those described in U.S. Pat. Nos. 4,148,761 and 4,207,369, a preference for particle size of below 10 μm is stated. Though the reason for the preference for this particle size is not known with certainty, it is likely that the resistivity of the prior art system is limited by the degree of mixing of the silicon and aluminum metals whereas, in the conductor compositions of the invention, the silicon is perfectly mixed with the aluminum by virtue of its morphology. It is believed that high electrical conductivity is limited by the amount of surface oxide on the particles. Thus, finer particles would be expected to have proportionately larger amounts of oxides.

B. Glass Binder

Glasses and other inorganic binders used in conductors perform several functions. The primary function of binders is to provide chemical or mechanical bonding to the substrate. They also facilitate sintering of the metal film by means of liquid phase sintering. Therefore the glassy binder must wet the metal surface. It is preferred that the glass binder have a softening point below 600° C. in order that the glass have adequate fusion properties. These are needed for adhesion to the substrate and protection of the conductive material from oxidation.

Although the chemical composition of the binder system is not critical to the functionality of these thick film conductor compositions, except as noted below, the inorganic binder should melt or flow at a sufficiently low temperature partially to encapsulate the metal particles during sintering and hence further reduce oxidation.

Though all conventional glasses can be used as the inorganic binder for the compositions of the invention, it has nevertheless been found that nonreducing glasses, suh as lead-free glasses, give from 10 to 15% lower resistivities over the entire range of metal loading. For example, at 72% weight metal the use of lead-containing glass gives a Sheet Resistance of about 3.5 milliohms per square whereas the substitution of an equal amount of nonreducing lead free glass gives a resistance value of about 3.0 milliohms per square under equivalent conditions.

For the purpose of this invention appropriate nonreducing glasses are those whose components cannot be chemically reduced by aluminum at normal firing temperatures. Typically this temperature is below 700° C. Therefore, a nonreducing glass cannot contain such materials as bismuth oxide, lead (II) oxide, iron (II) oxide, iron (III) oxide, copper (I) oxide, copper (II) oxide, cadmium oxide, chromium (III) oxide, indium oxide, tin (II) oxide or tin (IV) oxide. This list is not meant to be all inclusive, but rather representative. Other oxides cannot be used if the free energy of reaction for $MO_x+2Al \rightarrow Al_2O_3+MO_{x-3}$ is less than zero. Typical constituents which can be used in a nonreducible glass are boron oxide, silicon oxide, aluminum oxide, lithium oxide and barium oxide. Again, this is not meant to be an inclusive list but representative of usable components. Representative nonreducing glasses are disclosed in U.S. 4,271,236 to D'Addieco.

C. Formulation

The aluminum/silicon conductor composition will ordinarily be formed into paste which is capable of being printed in any desired circuit pattern.

Any suitably inert liquid can be used as the vehicle and nonaqueous inert liquids are preferred. Any one of various organic liquids with or without thickening agents, stabilizing agents and/or other common additives can be used. Exemplary of the organic liquids which can be used are alcohols, esters of such alcohols such as the acetates and propionates, terpenes such as pine oil, terpineol and the like, solutions of resins such as polymethacrylates or solutions of ethyl cellulose in solvents such as pine oil and mono-butyl ether of ethylene glycol mono-acetate. The vehicle can also contain volatile liquids to promote fast setting after printing to the substrate.

A preferred vehicle is based on a combination of a thickener consisting of ethyl cellulose in terpineol (ratio 1 to 9), combined with varnish and butyl carbitol acetate. The weight ratio of thickener to varnish to butyl carbitol acetate is 1.1:1.4. The pastes are conveniently prepared on a three-roll mill. A preferred viscosity for these compositions is approximately 30–40 Pa·S measured on a Brookfield HBT viscometer using a #7 spindle. The amount of thickener utilized is determined by the final desired formulation viscosity, which, in turn, is determined by the printing requirement of the system.

D. Applications

The weight ratio of functional (conductive) phase to binder phase which can be used in the invention varies from as low as 2 to as high as 40. Above 40 the resistivity of the composition increases to 60 milliohms per square and higher because of oxidation of the conductive phase. Hence, it is important to maintain sufficient glass phase to inhibit oxidation. It is therefore preferred to operate at a ratio of 30 or below. On the other hand it is feasible to operate at quite low functional/binder ratios without severely degrading resistivity properties. However, because the net effect of using lower ratios is to dilute the conductive phase with nonconductive glass, there is some increase in resistance. For this reason it is preferred to use a functional/binder ratio of at least 10 and preferably 15. An optimum ratio has been found to lie at a weight ratio of 15–16.

The conductor composition of the invention can be printed onto a substrate using conventional screen-printing techniques. The substrate is generally soda-lime window glass, although any glass or ceramic can be used. The following procedure is used to produce defogger circuits in the laboratory:

1. The aluminum/silicon conductor is screen printed onto a flat glass plate using a conventional screen, typically 200 mesh, although a wide range of mesh sizes can be used with equal success;
2. The printed pattern is dried at 200° C. for 15 minutes;
3. The glass plate is then fired for 7 minutes in a box furnace at 600°–700° C.; (At the higher temperatures the glass is sufficiently soft that it tends to bend. Therefore it may be necessary to support the glass.)
4. The glass is allowed to cool in air.

Testing

Resistance:

The resistance of an 800 square serpentine pattern with a width of 0.8 mm and a total length of 637 mm was measured using a 1702 ohmmeter manufactured by the Electro Scientific Instrument Company. The ohms per square were calculated by dividing the resistance by 800.

Humidity Resistance

A set of fired circuits were put in a humidity chamber set at 90% relative humidity and 50° C. The change in resistance was measured and recorded periodically up to 1100 hours. Although most of the change in resistance occurs within the first 300 hours, the total percent change for 1100 hours is reported.

Life Test

A defogger circuit was printed on a 12 in. by 12 in. glass plate dried and fired in a commercial glass plant. Firing temperature was about 640° C. The circuit whose initial resistance of 0.462 ohms was connected to an AC power source with a voltage of 5.5 volts. The glass was covered with a fine spray of water which was evaporated by the Joulean heat created in the circuit. The voltage was then turned off and the glass cooled by spraying with methanol. The glass was resprayed, the voltage turned on and the cycle repeated.

The resistance of the defogger grid was measured periodically up to 100 cycles. The life test result is reported as percent difference after 100 cycles.

EXAMPLE 1

A printable conductor paste was formulated in the manner described hereinabove having the following composition:

| | |
|---|---|
| Si/Al eutectic powder | 77 wt % |
| Glass frit | 5 |
| Organic vehicle | 18 |
| | 100 |

The glass frit was a nonreducing glass having a softening point below 600° C. and having the following composition:

| | |
|---|---|
| $Na_2O$ | 14.6 wt % |
| $K_2O$ | 5.5 |
| BaO | 17.7 |
| $B_2O_3$ | 58.5 |
| $Al_2O_3$ | 3.7 |
| | 100.0 |

The above-described paste was screen printed through a 200 mesh stainless steel screen onto standard soda-lime glass in a serpentine pattern, dried and fired at about 640° C. Upon cooling the pattern was found to have the following properties.

| | |
|---|---|
| Resistance | 3.86 m/ |
| Resistance change at 95% RH, 50° C., 1100 hours | 9.4% |
| Resistance change during Life test | 2.9% |

From the above indicated results it is apparent that the pattern had very good (low) resistivity and excellent resistance to change under severe humidity and load conditions.

EXAMPLE 2

In the following example several conductor pastes were formulated in the manner of Example 1 using Si/Al eutectic powder of different average particle size. The resultant pastes were then printed, dried and fired in the manner of Example 1 except that samples of each paste were fired at three different temperatures. The resultant printed test patterns were then tested for resistivity.

| | Firing temperature, °C.* | | |
|---|---|---|---|
| | 620 | 640 | 660 |
| | Resistivity Ω/□ | | |
| 3 μm Average particle size | 6.03 | 6.98 | 6.41 |
| 15 μm Average particle size | 3.62 | 2.29 | 2.83 |

*Indicated furnace setting

The larger size conductor particles gave substantially lower resistivity than the smaller particles. Hence larger particles are preferred for the practice of the invention here, which is quite contrary to the teachings of U.S. Pat. Nos. 4,148,761 and 4,207,369.

EXAMPLE 3

A further set of experiments was conducted in which several samples of the conductor paste of Example 1 where printed in the same manner but were each fired at different temperatures ranging from 570° C. to 728° C. The resistivity data from each of these materials indicates that firing temperature is quite important and that optimum resistivity is obtained between about 600° C. and 710° C., and especially between about 640° C. and 700° C.

| Firing temperature* °C. | 570 | 592 | 613 | 637 | 667 | 680 | 705 | 728 |
|---|---|---|---|---|---|---|---|---|
| Resistivity, mΩ/□ | 150 | 11.3 | 5.8 | 4.3 | 3.6 | 3.8 | 3.8 | 6.2 |

*Thermocouple measurement

EXAMPLE 4

A first printable conductor paste was formulated in the manner of Example 1 having the following composition:

| | |
|---|---|
| Si/Al eutectic powder | 73 wt. % |
| Glass frit | 10 |
| Organic vehicle | 17 |
| | 100 |

A second printable conductor paste was formulated in the manner of Example 1 substituting for the eutectic powder separate powders of aluminum and silicon. The powders of both the first and second pastes were of a size which would pass a 325 Standard Mesh Screen. The second paste had the following composition:

| | |
|---|---|
| Si metal powder | 8.8 wt. % |
| Al metal powder | 64.2 |
| Glass frit | 10.0 |
| Organic vehicle | 17.0 |
| | 100.0 |

Five samples of each of the above described pastes were screen printed onto standard soda-lime glass in a serpentine pattern, dried and fired at about 640° C. Upon cooling, the patterns were tested for resistivity. Quite surprisingly, the pastes containing the aluminum and silicon as an eutectic mixture, in which silicon metal crytallites were dispersed in a matrix of aluminum, had an average resistivity of only 4.77±0.33 mΩ/□, whereas the corresponding samples using the separate metal powders had average resistivities of 36.2±1.7 mΩ/□, over seven times as great. Thus, even though the amounts of silicon and aluminum in the samples were identical, the ones formulated with the dispersion of silicon in aluminum had much better (lower) resistivity.

EXAMPLE 5

A further series of thick film conductor pastes was formulated in the manner of Example 1 using 73% by weight metal components in each member of the series. The amount of Al/Si eutectic in the samples ranged from zero to 70% by weight, the remainder of the metal component being from 73 to 3% by weight respectively.

Five samples of each paste were screen printed onto standard soda-lime glass in a serpentine pattern, dried and fired at about 640° C. Upon cooling, the patterns were tested for resistivity with the following results:

| Al/Si Eutectic Powder, % wt. | 70 | 67 | 60 | 30 | 0 |
|---|---|---|---|---|---|
| Aluminum Powder, % wt. | 3 | 6 | 13 | 43 | 73 |
| Resistivity mΩ/□ | 5.7 (±0.17) | 5.29 (±0.82) | 6.10 (±0.60) | 10.35 (±0.71) | 45.6 (±6.2) |

These data are quite interesting and surprising as well in that, despite the fact that the amount of conductive metal in the samples was progressively increased by substituting aluminum powder for Al/Si eutectic, the resistivity of the samples became increasingly higher. Thus, despite the fact that nonconductive silicon metal was being taken out of the system and highly conductive aluminum was being added in its place, the resistivity of the composition still rose.

I claim:

1. Conductive powder composition comprising an admixture of finely divided particles of (a) 1.65–25% by wt. silicon dispersed in a matrix of 98.35–75% by wt. aluminum metal and (b) glass, having a softening point below 600° C., the weight ratio of metal to glass being from 2 to 40.

2. The composition of claim 1 in which the weight ratio of conductive owder to glass is 15–30.

3. The composition of claim 1 in which the glass is nonreducible upon firing.

4. The composition of claim 1 in which the particle sizes of the conductive powder are at least 10 μm.

5. The composition of claim 1 in which the silicon content of the conductive powder is from 5–25% by weight.

6. The composition of claim 1 in which the silicon dispersion is derived from a molten eutectic solution of silicon in aluminum.

7. A screen printable conductor composition comprising the conductive powder composition of claim 1 dispersed in an organic medium.

8. The composition of claim 7 in which the weight ratio of conductive powder to glass is 15–30.

9. The composition of claim 7 in which the glass is nonreducible upon firing.

10. The composition of claim 7 in which the particle sizes of the conductive powder are at least 10 μm.

11. The composition of claim 7 in which the silicon content of the conductive is from 5–25% by weight.

12. The composition of claim 7 in which the silicon dispersion is derived from a molten eutectic solution of silicon aluminum.

* * * * *